US010774521B2

(12) United States Patent
Yabushita et al.

(10) Patent No.: US 10,774,521 B2
(45) Date of Patent: Sep. 15, 2020

(54) STRUCTURE AND USE OF A PANEL WITH INTEGRATED AIR CONDITIONER FOR PREFABRICATED HOUSES

(71) Applicant: SANKYO FRONTIER CO., LTD., Kashiwa-shi, Chiba (JP)

(72) Inventors: Shinichiro Yabushita, Kashiwa (JP); Masaki Matsui, Kashiwa (JP); Kazunori Kamata, Kashiwa (JP)

(73) Assignee: SANKYO FRONTIER CO. LTD., Kashiwa-Shi, Chiba (JP)

( * ) Notice: Subject to any disclaimer, the term of this patent is extended or adjusted under 35 U.S.C. 154(b) by 0 days.

(21) Appl. No.: 16/093,613

(22) PCT Filed: Apr. 13, 2017

(86) PCT No.: PCT/JP2017/015111
§ 371 (c)(1),
(2) Date: Oct. 12, 2018

(87) PCT Pub. No.: WO2017/179651
PCT Pub. Date: Oct. 19, 2017

(65) Prior Publication Data

US 2019/0071860 A1 Mar. 7, 2019

(30) Foreign Application Priority Data

Apr. 14, 2016 (JP) ..... 2016-081066

(51) Int. Cl.
*E04B 1/348* (2006.01)
*F24F 13/32* (2006.01)
(Continued)

(52) U.S. Cl.
CPC ..... *E04B 1/34807* (2013.01); *E04B 2/707* (2013.01); *F24F 1/62* (2013.01);
(Continued)

(58) Field of Classification Search
CPC . B62B 1/002; B62B 2203/07; B62B 2203/10; B62B 3/04; B62B 3/08;
(Continued)

(56) References Cited

U.S. PATENT DOCUMENTS 4,258,826 A * 3/1981 Murray ..... B62B 1/002 182/103
4,474,115 A * 10/1984 Carlton ..... A47B 37/02 108/7

(Continued)

FOREIGN PATENT DOCUMENTS

JP 3164750 * 12/2010
JP 3164750 U 12/2010

*Primary Examiner* — Brian E Glessner
*Assistant Examiner* — Daniel J Kenny
(74) *Attorney, Agent, or Firm* — Bayramoglu Law Offices LLC

(57) ABSTRACT

An object is to provide an air conditioner-incorporating panel for a prefabricated house which can be safely moved so as to enhance the efficiency of operating of a step of assembling the prefabricated house.

An outdoor unit P for an air conditioner is fixed to the outer surface of a wall panel 1 that is fitted to a prefabricated house. An indoor unit Q is fixed to the inner surface of the wall panel 1. A support base 2 is provided below the outdoor unit P on the side of a lower end portion of the outer surface of the wall panel 1. The wall panel 1, supported by the support base 2, is inclined so as to stand on its own at such an angle that loads on the inner and outer surfaces are equalized. Casters 3 are fitted to the lower surface of the support base 2.

3 Claims, 7 Drawing Sheets

(51) Int. Cl.

| | |
|---|---|
| ***F24F 1/62*** | (2011.01) |
| ***E04B 2/70*** | (2006.01) |
| *E04B 2/90* | (2006.01) |
| *E04B 2/74* | (2006.01) |
| *F24F 1/027* | (2019.01) |

(52) U.S. Cl.
CPC ..... *F24F 13/32* (2013.01); *E04B 2/7425* (2013.01); *E04B 2/90* (2013.01); *F24F 1/027* (2013.01); *F24F 2221/36* (2013.01)

(58) Field of Classification Search
CPC ..... B66F 7/22; B66F 7/0625; B65G 65/23; B65G 7/08; E04B 1/34807; E04B 1/348; F24F 1/62
USPC ..... 414/642; 280/47.131, 43.1
See application file for complete search history.

(56) References Cited

U.S. PATENT DOCUMENTS

| | | | | | |
|---|---|---|---|---|---|
| 4,592,447 | A * | 6/1986 | Ream | B66F 11/04 | 180/8.2 |
| 4,703,701 | A * | 11/1987 | Sema | A47B 17/02 | 108/10 |
| 5,779,251 | A * | 7/1998 | Meier | B62B 1/002 | 188/22 |
| 6,079,925 | A * | 6/2000 | Morgan | E21B 19/14 | 414/22.57 |
| 6,379,097 | B1 * | 4/2002 | Vondenhuevel | B65G 65/23 | 414/414 |
| 7,628,408 | B2 * | 12/2009 | Kolesa | B62B 3/08 | 280/47.27 |
| 8,192,134 | B2 * | 6/2012 | Brewer, III | B62B 1/14 | 254/3 C |

* cited by examiner

STRUCTURE AND USE OF A PANEL WITH INTEGRATED AIR CONDITIONER FOR PREFABRICATED HOUSES

TECHNICAL FIELD

The present invention relates to an air conditioner-incorporating panel for a prefabricated house which is produced in a factory, which is used as a wall panel for a prefabricated house that is assembled locally and in which an air conditioner such as an air-conditioning device is previously fitted to a wall panel.

BACKGROUND ART

Conventionally, as this type of wall panel for a prefabricated house, an air conditioner-incorporating panel which is previously proposed by the present applicant is disclosed in patent literature 1. In this air conditioner-incorporating panel, when an air conditioner is attached to a prefabricated house, a wall panel to which the air conditioner is attached is formed as a unit, and thus an operation of attaching the air conditioner is simplified, and the wall panel can also be reused.

Specifically, in the prefabricated house, on the inner and outer surfaces of the wall panel, the outdoor unit and the indoor unit of the air conditioner are previously assembled, the outdoor unit and the indoor unit are previously connected with cooling piping and a wiring code and thus a panel unit for an air conditioner is formed.

With the panel unit for an air conditioner as described above, an operation of processing a wiring outlet and a wiring operation which are performed locally are not needed at all, the operation of attaching the air conditioner can be simplified and moreover, the wall panel together with the air conditioner can be reused.

CITATION LIST

Patent Literature

Patent Literature 1: Japanese Utility Model No. 3164750

SUMMARY OF INVENTION

Technical Problem

However, since in the air conditioner-incorporating panel disclosed in patent literature 1, on the inner and outer surfaces of the wall panel for a prefabricated house, the outdoor unit and the indoor unit of the air conditioner are previously assembled, the entire wall panel is very heavy in weight. Consequently, an operation of moving the air conditioner-incorporating panel is very difficult to perform.

Specifically, the outdoor unit is fitted to the outer surface of the wall panel, the indoor unit is fitted to the inner surface and moreover and the indoor unit is often arranged in an upper portion of the wall panel, with the result that the weight balance of the wall panel is brought into a special state.

Hence, conventionally, in order to easily transport an air conditioner-incorporating panel, casters are fitted to the lower end portion of a wall panel such that the air conditioner-incorporating panel can be moved by utilization of the casters. However, it is considerably difficult to move the air conditioner-incorporating panel while balancing the outdoor unit fixed to a lower portion of the outer surface of the wall panel and the indoor unit fixed to an upper portion of the inner surface of the wall panel.

In other words, at the time of the movement, an operator moves the air conditioner-incorporating panel while inclining the wall panel and maintaining such an angle that loads on the outer surface and the inner surface are equalized. However, when the angle at which the loads are balanced is only slightly displaced at the time of the movement, an unexpected load is applied to the wall panel, and thus there is a danger that the balance at the time of the movement is greatly disturbed, with the result that the operator may be swayed by the unexpected load.

Hence, the present invention is made so as to remove the problem described above, and an object of the present invention is to provide an air conditioner-incorporating panel for a prefabricated house which can be safely moved so as to enhance the efficiency of operating of a step of assembling the prefabricated house.

Solution to Problem

In order to achieve the above object, a first means in the present invention is provided such that in an air conditioner-incorporating panel for a prefabricated house in which an outdoor unit P for the air conditioner is fixed to the outer surface of a wall panel 1 and in which an indoor unit Q is fixed to the inner surface, a support base 2 is provided below the outdoor unit P on the side of a lower end portion of the outer surface of the wall panel 1, the wall panel 1 which stands on its own at such an angle that loads on the inner and outer surfaces of the wall panel 1 are equalized is supported by the support base 2 and casters 3 for moving the wall panel 1 in a state where the wall panel 1 stands on its own are fitted to the lower surface of the support base 2.

In a second means, the support base 2 includes: a pair of inclination members 4 which are fixed to the left and right sides of the outer surface on the side of the lower end portion of the wall panel 1 and whose bottom surfaces are inclined so as to support the inclined wall panel 1 in the state where the wall panel 1 stands on its own; support levers 5 which are mutually placed on the inclination members 4 and which place and fix the outdoor unit P horizontally when the outdoor unit P is installed; and the casters 3 which are arranged on the fronts and backs of the bottom surfaces of the inclination members 4.

The casters 3 of a third means are fitted to both longitudinal end portions of caster support levers 6 which are fitted to the interiors thereof, one end portions of the caster support levers 6 are coupled to the sides of the inclination members 4 on the side of the wall panel 1 such that the caster support levers 6 freely swing, angle adjustment levers 7 are coupled to the other end portions of the caster support levers 6 such that the angle adjustment levers 7 freely swing, the caster support levers 6 in a horizontal state are extended out from the inclined bottom surfaces of the inclination members 4 and the inclination members 4 are supported horizontally by the angle adjustment levers 7 which are arranged so as to stand vertically such that the inclined wall panel 1 is kept vertically.

One end portions of the angle adjustment levers 7 of a fourth means are coupled to the caster support levers 6 such that the angle adjustment levers 7 freely swing, the other end portions are coupled to the lower surfaces of the inclination members 4, a pair of screwing portions 7A whose fixed angles are different are formed in the other end portions of the angle adjustment levers 7 and one of the screwing portions is selected so as to screw the angle adjustment levers 7 in a position in which the caster support levers 6 are stored within the inclination members 4 or in a position in which the inclination members 4 are supported horizontally by the angle adjustment levers 7 of the caster support levers 6.

Advantageous Effects of Invention

According to claim 1 in the present invention, the support base 2 is provided below the outdoor unit P on the side of the lower end portion of the outer surface of the wall panel 1, the wall panel 1 which stands on its own at such an angle that the loads on the inner and outer surfaces of the wall panel 1 are equalized is supported by the support base 2 and the casters 3 for moving the wall panel 1 in the state where the wall panel 1 stands on its own are fitted to the lower surface of the support base 2, with the result that the air conditioner-incorporating panel can be moved very safely. Moreover, the air conditioner-incorporating panel can easily be moved to the position in which the wall panel 1 is attached, and thus it is possible to enhance the efficiency of operating of a step of assembling the prefabricated house.

As in claim 2, the support base 2 includes: the pair of inclination members 4 which are fixed to the left and right sides of the outer surface of the lower end portion of the wall panel 1 and whose bottom surfaces are inclined so as to support the inclined wall panel 1 in the state where the wall panel 1 stands on its own; the support levers 5 which are mutually placed on the inclination members 4 and which place and fix the outdoor unit P horizontally when the outdoor unit P is installed; and the casters 3 which are arranged on the fronts and backs of the bottom surfaces of the inclination members 4, and thus the wall panel 1 can be made to stand on its own in a well-balanced manner by effective utilization of the loads of the indoor unit P. Consequently, when the wall panel 1 is moved while the inclined wall panel 1 is being supported in the state where the wall panel 1 stands on its own, the stable standing on its own and the stable movement are realized.

As in claim 3, the casters 3 are fitted to both longitudinal end portions of the caster support levers 6 which are fitted to the interiors of the inclination members 4, one end portions of the caster support levers 6 are coupled to the sides of the inclination members 4 on the side of the wall panel 1 such that the caster support levers 6 freely swing, the angle adjustment levers 7 are coupled to the other end portions of the caster support levers 6 such that the angle adjustment levers 7 freely swing, the caster support levers 6 in the horizontal state are extended out from the inclined bottom surfaces of the inclination members 4 and the inclination members 4 are supported horizontally by the angle adjustment levers 7 which are arranged so as to stand vertically such that the inclined wall panel 1 is kept vertically, with the result that the wall panel 1 before being assembled in the prefabricated house can be stored in a warehouse or the like in a vertical state. Hence, it is possible to manage the wall panel 1 before use in a stable state.

According to claim 4, the one end portions of the angle adjustment levers 7 are coupled to the caster support levers 6 such that the angle adjustment levers 7 freely swing, the other end portions are coupled to the lower surfaces of the inclination members 4, the pair of screwing portions 7A whose fixed angles are different are formed in the other end portions of the angle adjustment levers 7 and one of the screwing portions is selected so as to screw the angle adjustment levers 7 in the position in which the caster support levers 6 are stored within the inclination members 4 or in the position in which the support levers 5 are supported horizontally by the angle adjustment levers 7 of the caster support levers 6, with the result that both in the position in which the support levers 5 are in the inclined state and in the position in which the support levers 5 are in the horizontal state, the angle adjustment levers 7 can be securely fixed with a simply operation.

As described above, according to the present invention, the original object is achieved in which the air conditioner-incorporating panel for a prefabricated house can be safely moved so as to enhance the efficiency of operating of the step of assembling the prefabricated house.

DESCRIPTION OF EMBODIMENTS

Figure 1:
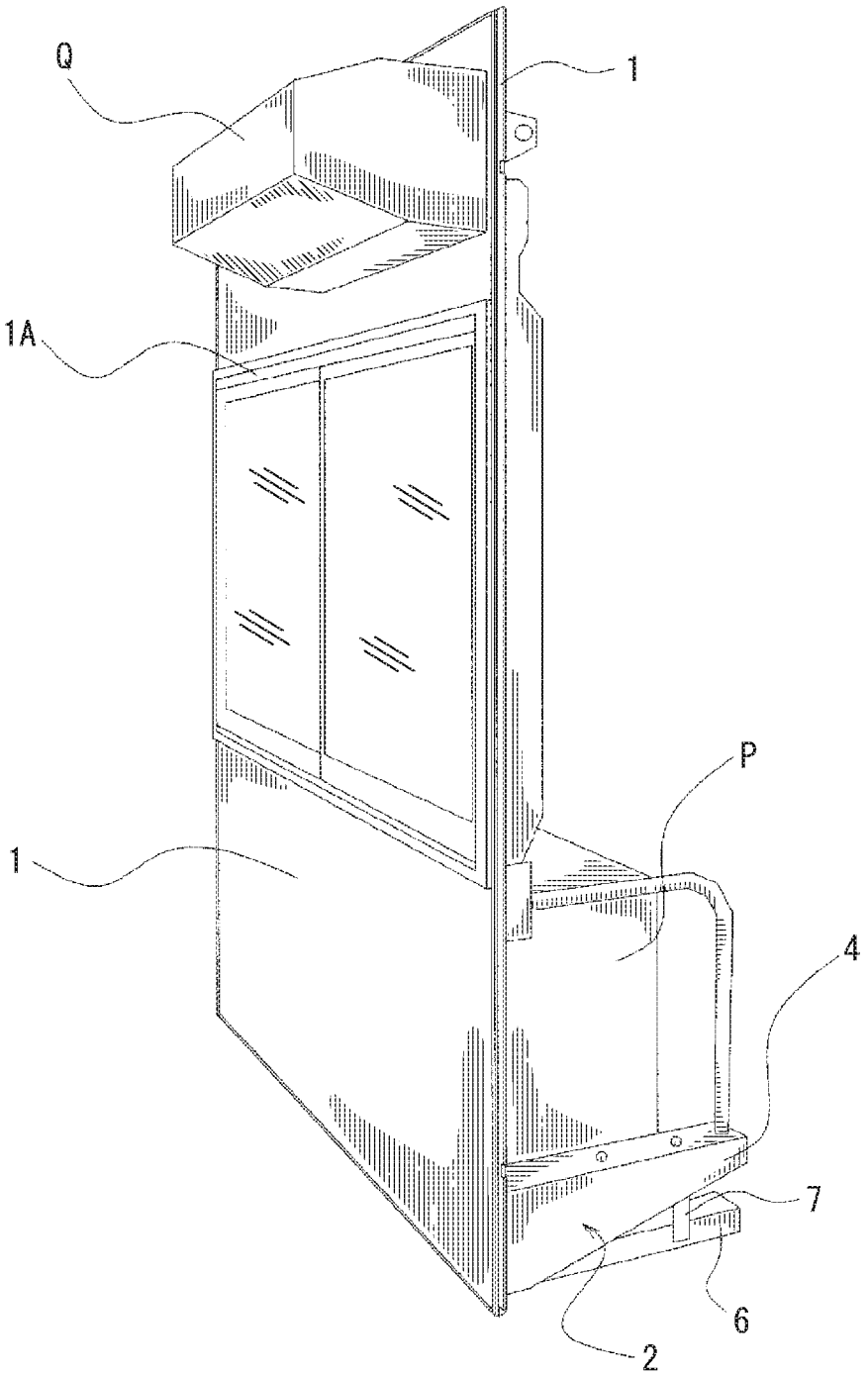
FIG. 1 is a perspective view showing an embodiment of the present invention.

An embodiment of the present invention will be described below. The present invention is used as a wall panel 1 for a prefabricated house, and an outdoor unit P for an air conditioner is fitted to the outer surface of the wall panel 1 and an indoor unit Q is attached to the inner surface (see FIG. 1). Furthermore, within a wiring pipe R, a power supply and a coolant pipe are connected (see FIG. 2). The illustrated wall panel 1 is a wall panel 1 in which a window frame 1A is provided, and the outdoor unit P is installed below the window frame 1A and the indoor unit Q is installed above the window frame 1A (see FIG. 1).

Figure 3:
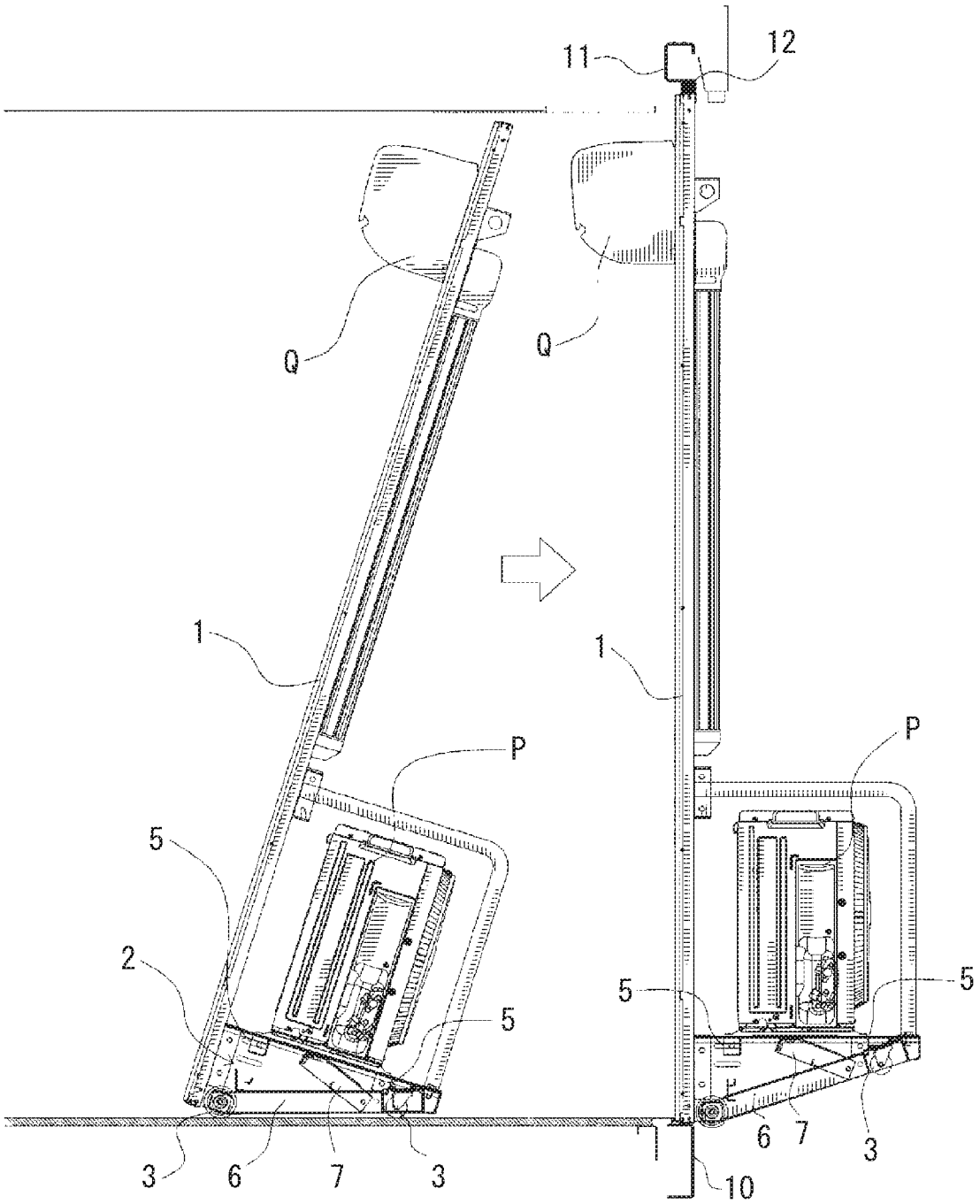
FIG. 3 is a side view showing a state where the present invention is moved and fitted.

When the wall panel 1 is moved, the wall panel 1 is moved in an inclined state such that an upper end portion of the wall panel 1 is prevented from hitting a ceiling (see FIG. 3). Here, a support base 2 is fitted to the bottom of the outdoor unit P that is fixed to the wall panel 1, and the wall panel 1 which stands on its own at such an angle that loads on the inner and outer surfaces of the wall panel 1 are equalized is supported by the support base 2. Furthermore, casters 3 are fitted to the lower surface of the support base 2, and the wall panel 1 can be moved with the casters 3 while the state where the wall panel 1 stands on its own is being maintained.

Figure 5:
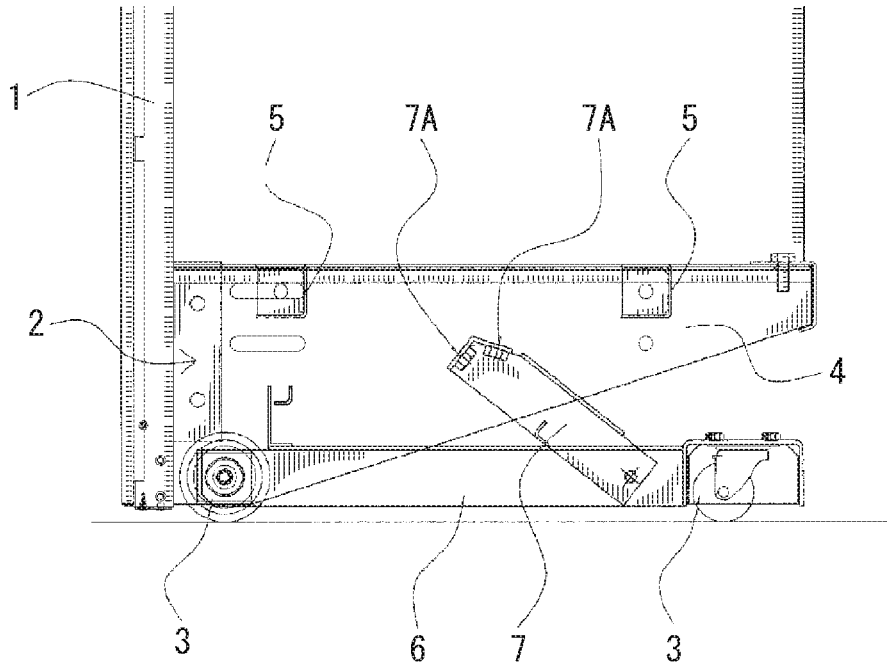
FIG. 5 is a cross-sectional side view showing the movements of a caster support lever and an angle adjustment lever in the present invention.

In the support base 2, the casters 3, inclination members 4, support levers 5, caster support levers 6 and angle adjustment levers 7 are provided (see FIG. 5).

The inclination members 4 are fixed to the left and right sides of the outer surface of a lower end portion of the wall panel 1 (see FIG. 2), and are a pair of support members whose bottom surfaces are inclined (see FIG. 5). A setting is made such that when the wall panel 1 is inclined along the inclined bottom surfaces of the inclination members 4, the wall panel 1 stands on its own at such an angle that the loads on the inner and outer surfaces of the wall panel 1 are equalized (see FIG. 4). Furthermore, the casters 3 are arranged on the fronts and the backs of the bottom surfaces of the inclination members 4, and with the casters 3 which are protruded downward with respect to the inclination members 4, the inclined wall panel 1 can be moved while the state where the wall panel 1 stands on its own is being maintained (see FIG. 3).

Figure 2:
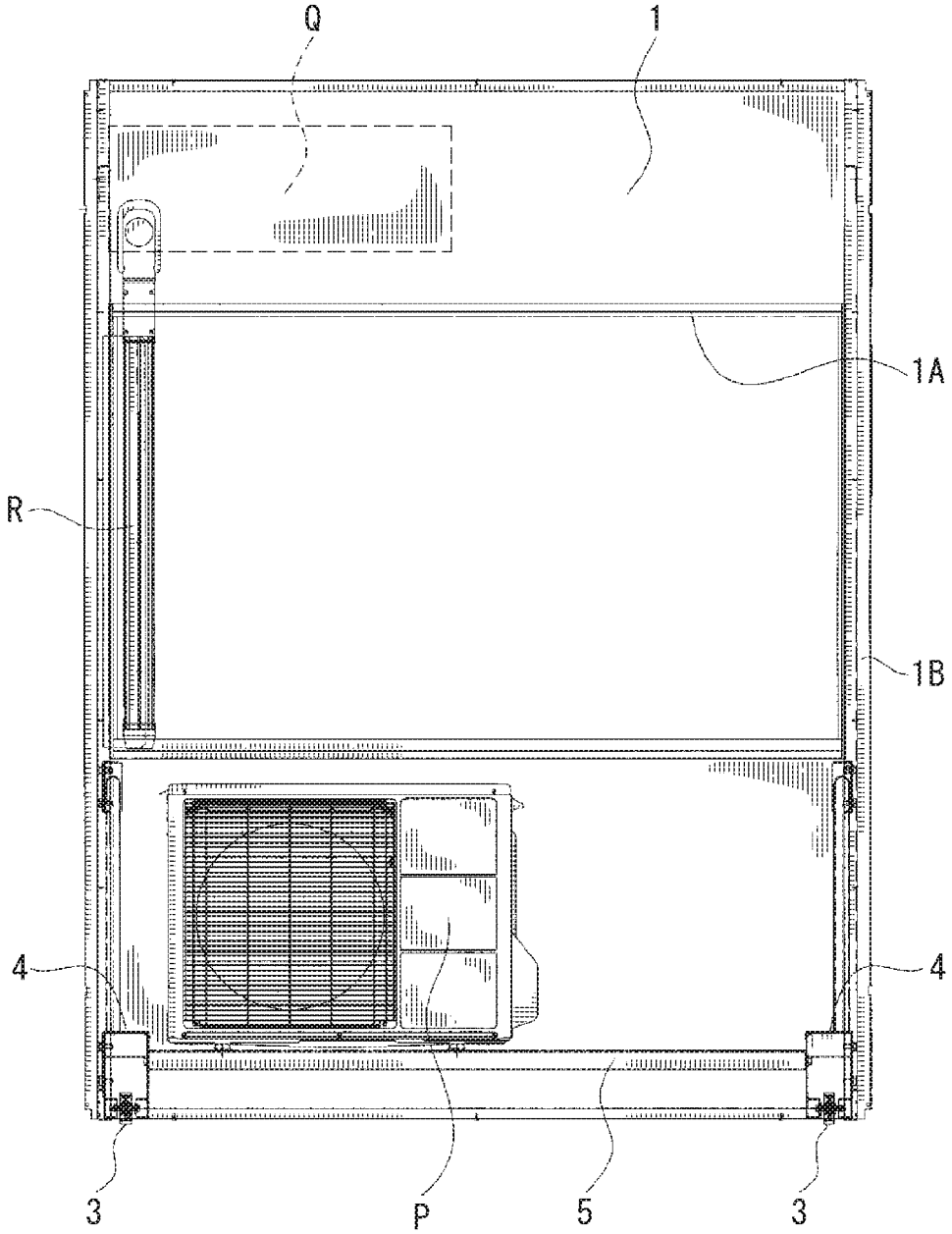
FIG. 2 is a front view showing the embodiment of the present invention.

The support levers 5 are a pair of beam members which are mutually placed on the inclination members 4 and which are parallel to each other, the outdoor unit P is placed on the support levers 5 so as to be fixed thereto and the wall panel 1 and the outdoor unit P are integrated through the support levers 5 (see FIG. 2). On the other hand, the indoor unit Q is directly fixed to the inner surface of the wall panel 1 (see FIG. 1).

Figure 6:
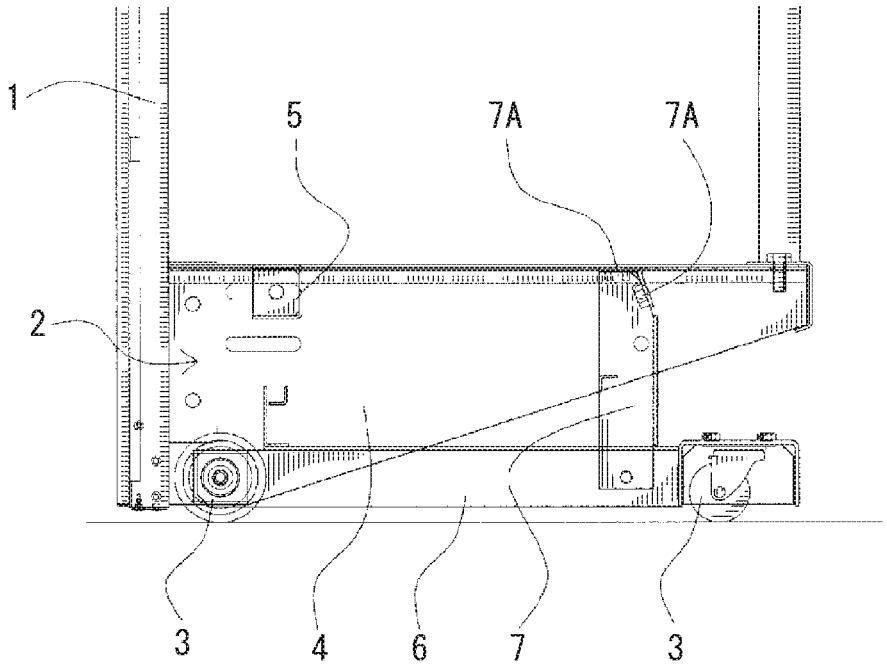
FIG. 6 is a cross-sectional side view showing a state where a support plate is supported by the angle adjustment lever in the present invention.

The caster support lever 6 is a lever-shaped member which is fitted to the interior of the inclination member 4, one end portion is coupled to the interior of the inclination member 4 such that the caster support lever 6 freely swings and the caster support lever 6 is provided so as to be extended out from the inclined bottom surface of the inclination member 4 in a horizontal state (see FIG. 5). The casters 3 are fitted to both longitudinal end portions of the caster support lever 6. Furthermore, the angle adjustment lever 7 is provided at the other end portion of the caster support lever 6 so as to freely swing. The angle adjustment levers 7 are arranged so as to stand vertically from the other end portions of the caster support levers 6, the inclination members 4 are supported horizontally by the angle adjustment levers 7 and thus the inclined wall panel 1 can be kept vertically (see FIG. 6).

Figure 4:
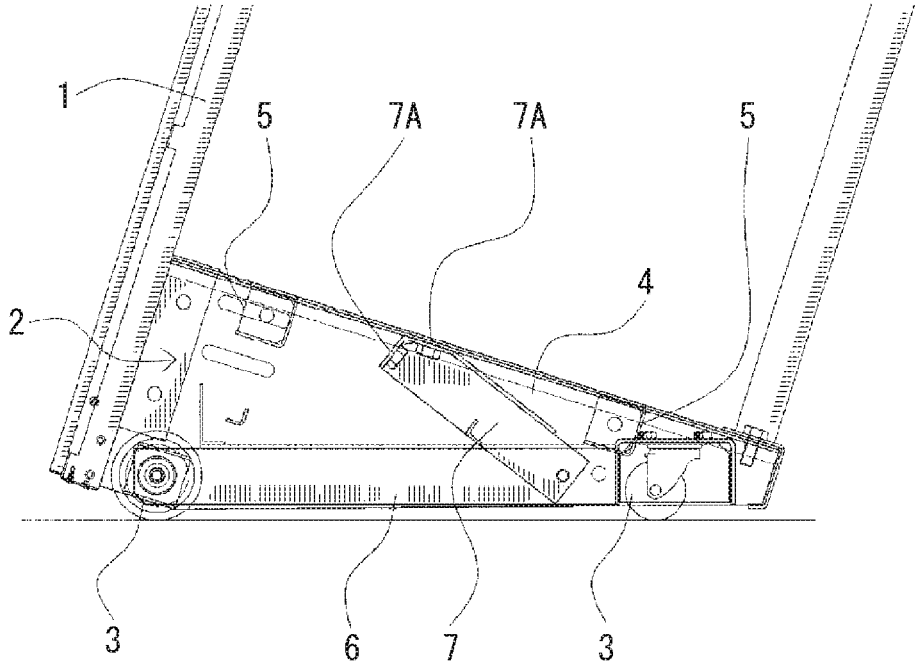
FIG. 4 is a cross-sectional side view showing a support base in the present invention.

The angle adjustment lever 7 is a lever-shaped member whose one end portion is coupled to the caster support lever 6 such that the angle adjustment lever 7 freely swings, and the other end portion is coupled to the inclination member 4 (see FIG. 4). Furthermore, at the other end portion of the angle adjustment lever 7, a pair of screwing portions 7A whose fixed angles are different are formed, and thus one of the screwing portions can be selected (see FIG. 5). Screwing is performed in a position in which the caster support lever 6 is stored within the inclination member 4 or in a position in which the support lever 5 is supported horizontally by the angle adjustment lever 7 of the caster support lever 6.

Specifically, one of the screwing portions 7A is provided so as to be inclined with respect to the side surface of the angle adjustment lever 7, and thus the inclination member 4 is fixed in a position in which the inclination member 4 is inclined (see FIG. 4). The other screwing portion 7A is provided at the longitudinal end portion of the angle adjustment lever 7, and thus the longitudinal end portion is fixed in a position in which the inclination member 4 is in a horizontal state (see FIG. 6). In the illustrated screwing portions 7A, fixing nuts are welded to the angle adjustment lever 7 (see FIG. 5), and bolt insertion holes which are screwed to the nuts are opened in the angle adjustment lever 7 and the inclination member 4.

When the wall panel 1 is moved, the angle adjustment levers 7 are fixed such that the bottom portions of the caster support levers 6 are parallel to the inclined bottom portion of the support base 2 (see FIG. 4). In this way, the wall panel 1 is supported by the casters 3 which are protruded downward from the caster support levers 6 at such an angle that the loads on the inner and outer surfaces of the wall panel 1 are equalized (see FIG. 3). Then, the wall panel 1 is moved in a state where the wall panel 1 is inclined so as to stand on its own while the angle is being maintained. Furthermore, when the wall panel 1 is close to a position in which the wall panel 1 is fitted, the wall panel 1 is arranged so as to stand vertically, the lower end portion of the wall panel 1 is placed on a floor beam 10 and the upper end portion of the wall panel 1 is fitted to a ceiling beam 11 through waterproof packing 12.

Figure 7:
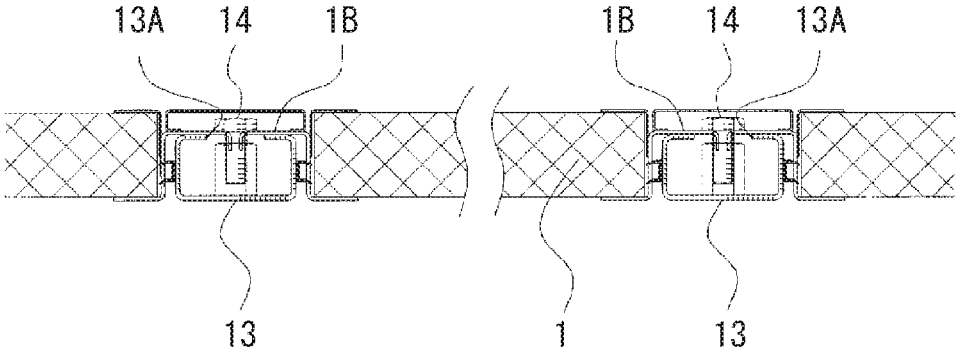
FIG. 7 is a cross-sectional plan view showing a state where the present invention is fixed to a prefabricated house.

In order for the wall panel 1 to be fixed to the prefabricated house, fixing frames 1B which are formed on the left and right sides of the wall panel 1 are inserted into slits 13A formed in the studs 13 of the prefabricated house so as to be locked thereto, and in this state, the wall panel 1 is fixed with fixing bolts 14 (see FIG. 7).

Figure 8:
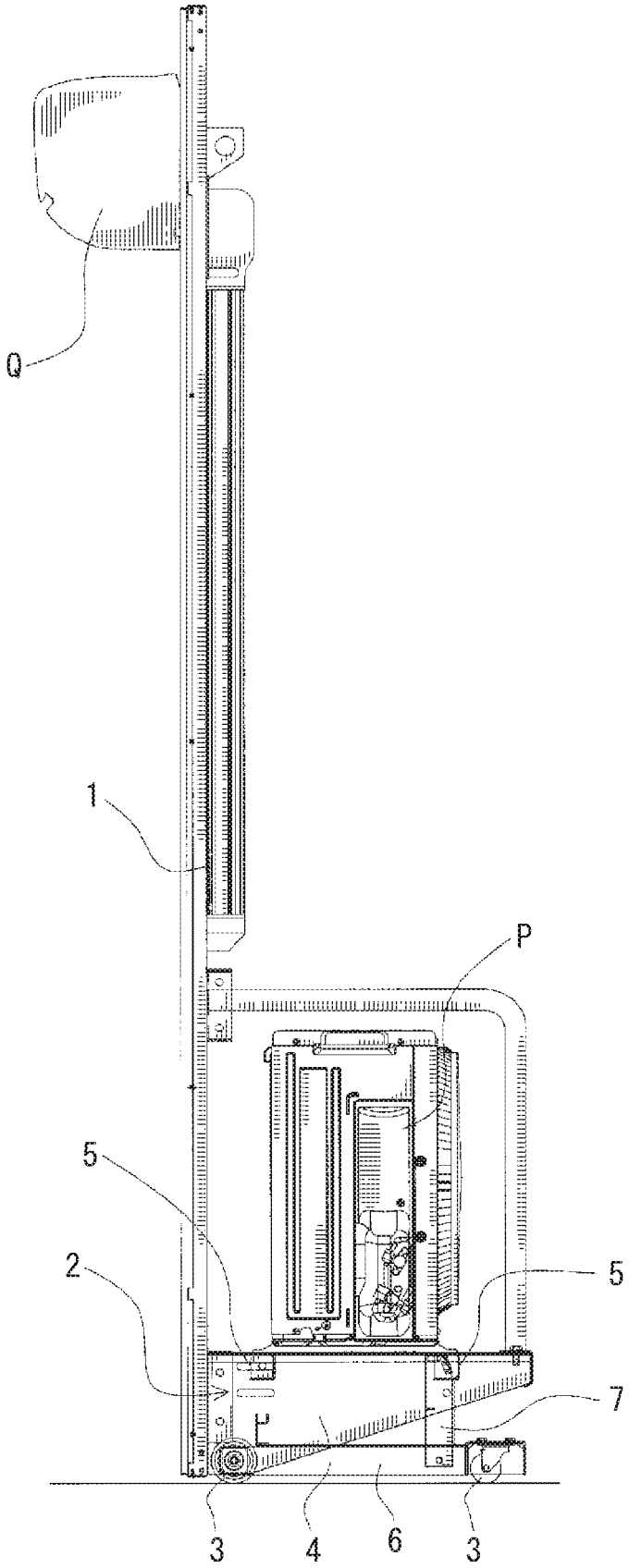
FIG. 8 is a side view showing a state where the present invention is stored.

When the wall panel 1 before being assembled in the prefabricated house is stored in a warehouse or the like, the support levers 5 are supported horizontally by the angle adjustment levers 7 which are arranged so as to stand vertically from the other end portions of the caster support levers 6 (see FIG. 8). The support levers 5 are supported in this way, and thus the wall panel 1 is kept vertically, with the result that wall panel 1 before being assembled in the prefabricated house can be stored in a vertical state.

The individual configurations of the illustrated example in the present invention are simply examples of the present invention, and the shape and the size of the wall panel 1, the shapes and the sizes of the outdoor unit P and the indoor unit Q, the attachment positions and the like can freely be changed without departing from the spirit of the present invention.

REFERENCE SIGNS LIST

P outdoor unit
Q indoor unit
R wiring pipe
1 wall panel
1A window frame
1B fixing frame
2 support base
3 caster
4 inclination member
5 support lever
6 caster support lever
7 angle adjustment lever
7A screwing portion
10 floor beam
11 ceiling beam
12 waterproof packing
13 stud
13A slit
14 fixing bolt

What is claimed is:

1. A wall panel for a prefabricated house the panel comprising an outdoor unit of an air conditioner fixed to an outer surface of the wall panel and an indoor unit fixed to an inner surface of the wall panel, a support base provided below the outdoor unit on a side of a lower end portion of the outer surface of the wall panel and the support base includes a pair of inclination members fixed to left and right sides of the outer surface on side edges of the lower end portion of the wall panel and whose bottom surfaces are inclined, wherein loads on the inner and outer surfaces of the wall panel are configured so that the wall panel can stand in an inclined state on its own with the wall panel supported by the support base, casters are fitted to a lower surface of the support base to support the wall panel in the inclined state while the wall panel rolls; supports are placed on the inclination members and fix the outdoor unit to the inclination members, wherein left and right casters of the casters which are fitted to the lower surface of the support base are respectively arranged on front, bottom surfaces of the inclination members, a first caster of the left and right casters fitted to the lower surface is fitted to a first end of a left longitudinal caster support, a second caster of the left and right casters fitted to the lower surface is fitted to a first end of a right longitudinal caster support, a third caster of the left and right casters fitted to the lower surface is fitted to a second end of the left longitudinal caster support, a fourth caster of the left and right casters fitted to the lower surface is fitted to a second end of the right longitudinal caster support, wherein the first end of the left longitudinal caster support is fitted into an interior of one of the inclination members and the first end of the right longitudinal caster support is fitted into an interior of another one of the inclination members where the left longitudinal caster support and the right longitudinal caster support freely swing, a first angle adjustment member is rotationally secured to the left longitudinal caster support, a second angle adjustment member is rotationally secured to the right longitudinal caster support, and wherein the first and second angle adjustment members hold the wall panel in a vertical position.

2. The wall panel according to claim 1, wherein each first end portion of the angle adjustment members is respectively coupled to the longitudinal caster supports such that the angle adjustment members freely swing and such that a pair of screwing portions whose fixed angles are different are formed in each second end portion of the angle adjustment members.

3. The wall panel according to claim 1, wherein the wall panel is installed vertically into the prefabricated house with an upper end portion thereof fitted into a ceiling beam of said prefabricated house.

* * * * *